United States Patent [19]

Bertolini et al.

[11] Patent Number: 4,822,328

[45] Date of Patent: Apr. 18, 1989

[54] FOLDING APPARATUS AND METHOD

[75] Inventors: Robert Bertolini, Green Bay; Bernard A. Arveson, Denmark, both of Wis.

[73] Assignee: Paper Converting Machine Company, Green Bay, Wis.

[21] Appl. No.: 136,109

[22] Filed: Dec. 21, 1987

[51] Int. Cl.[4] ..... B31F 1/08

[52] U.S. Cl. ..... 493/425; 270/39; 270/50; 493/432; 493/435; 493/429

[58] Field of Search ..... 493/424, 425, 432, 433, 493/434, 435, 442, 471, 476, 430, 426–430; 270/49, 50, 39

[56] References Cited

U.S. PATENT DOCUMENTS

| | | | |
|---|---|---|---|
| 1,871,301 | 8/1932 | Campbell | 270/39 |
| 2,126,537 | 8/1938 | Clauberg | 493/429 |
| 3,195,882 | 7/1965 | Nystrand . | |
| 3,528,651 | 9/1970 | Eriksen | 493/430 |
| 4,270,744 | 6/1981 | Trogan . | |

*Primary Examiner*—Frederick R. Schmidt
*Assistant Examiner*—Robert Showalter
*Attorney, Agent, or Firm*—Tilton, Fallon, Lungmus & Chestnut

[57] ABSTRACT

Apparatus and method for folding webs which includes a pair of rolls each having tuckers and grippers arranged for tucker-gripper coaction and wherein the tucker is free floating within its mounting advantageously of the order of 1/16" movement in a circumferential direction.

4 Claims, 1 Drawing Sheet

FIG. 1
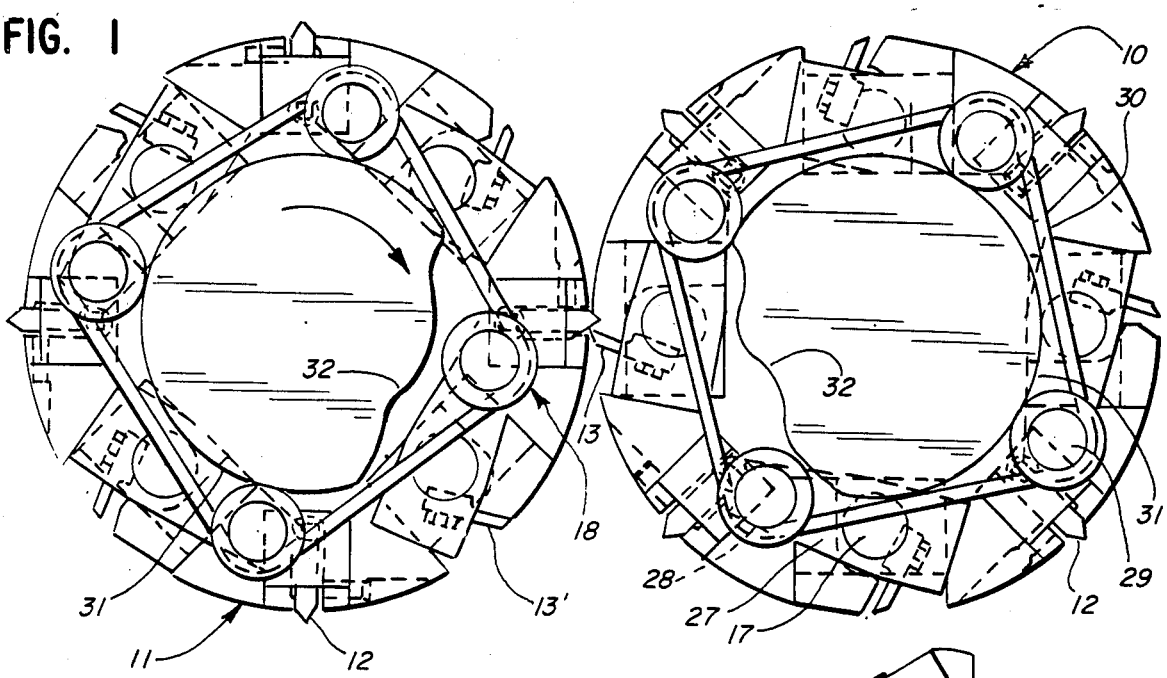
FIG. 3
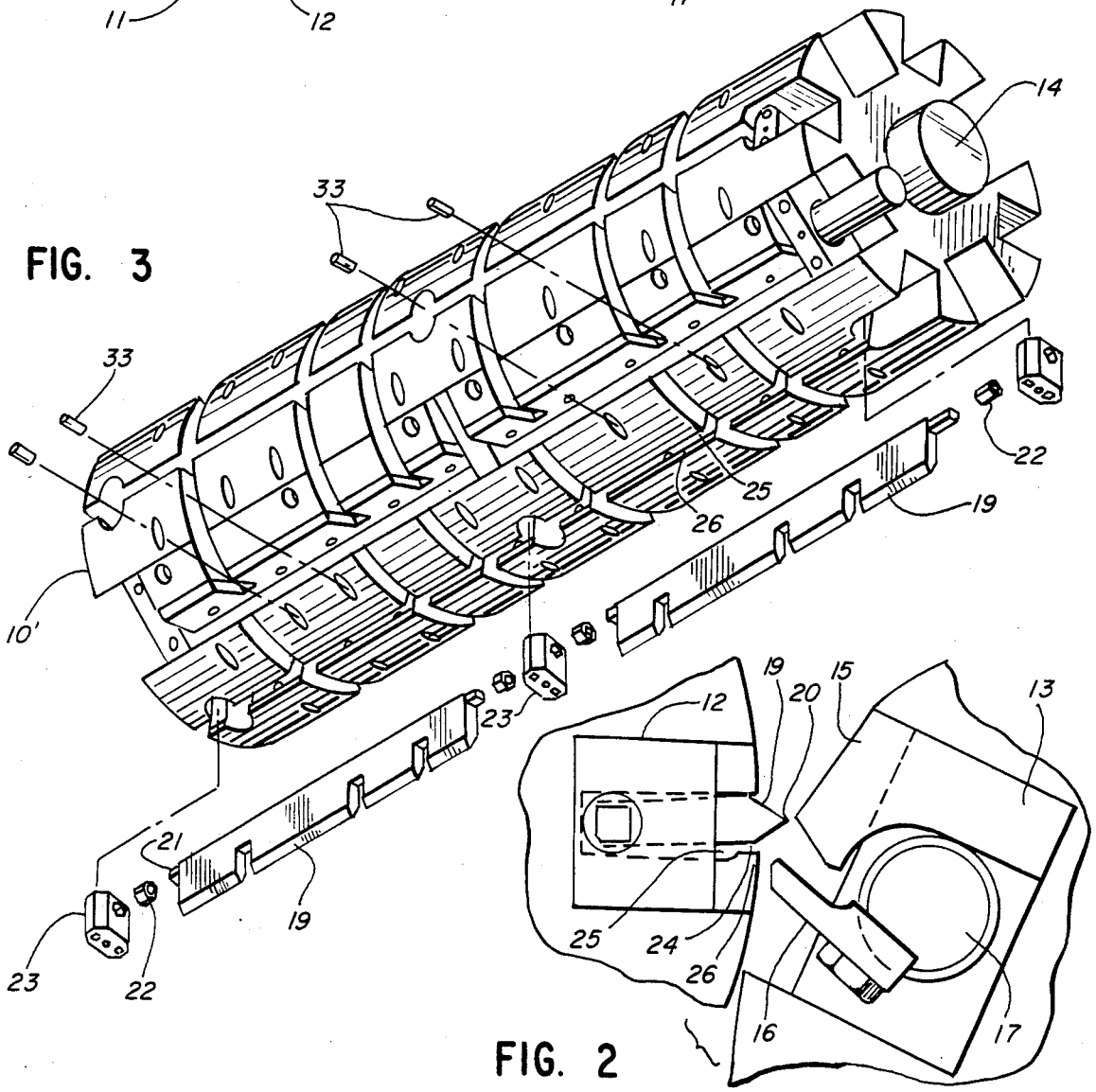
FIG. 2

FOLDING APPARATUS AND METHOD

BACKGROUND AND SUMMARY OF INVENTION

This invention relates to a folding apparatus and method and, more particularly, to an improved tucker for a gripper-tucker type folder.

Rotary folders have been known for a long time—see for example, co-owned U.S. Pat. No. 3,195,882. Such folders employed tuckers and grippers for achieving web folding and for the most part, the tuckers were fixed within the folding roll or rotating member. In some instances, the tuckers were spring loaded as exemplified by U.S. Pat. No. 4,270,744.

I have found that substantially improved performance can be achieved by changing the mounting of the tucker to a free floating style with limited movement. This and other attributes of the invention are set forth in the ensuing specification.

The invention is described in conjunction with an illustrative embodiment in the accompanying drawing in which FIG. 1 is a fragmentary end elevational view of apparatus embodying the teachings of this invention and featuring a pair of coacting folding rolls, each equipped with tuckers and grippers;

FIG. 2 is an enlarged fragmentary view showing the tucker of one roll about to enter the gripper of the companion roll; and FIG. 3 is a perspective view, partially exploded, of one of the identical folding rolls.

DETAILED DESCRIPTION

In the illustration given and with reference to FIG. 1, the numeral 10 designates generally a folding roll such as would be positioned on the front of folding apparatus while the numeral 11 designates generally an identical folding roll positioned on the rear of the apparatus. Each of the rolls 10 and 11 are "four time" rolls, i.e., each having four tuckers 12 and four grippers 13. As can be readily appreciated, the orientation of the rolls is such that the tucker of one roll engages the gripper of the other roll. In the illustration given, this is illustrated by the rolls being phased or angularly offset 45° relative to each other.

Each roll 10 and 11 is seen to have tuckers 12 arranged at 90° relative to each other as are the intermediate grippers 13. The roll seen in FIG. 3 is equipped with shaft extensions, one of which is seen at 14 at the right hand end for rotatably mounting the rolls in a conventional frame (not shown).

As can be better appreciated from a consideration of FIG. 2, each gripper assembly 13 includes an anvil 15 and a gripper element 16 mounted on a pivot shaft 17. The shaft 17 is actuated by a cam mechanism generally designated 18 in the central part of FIG. 1. This much is conventional and may be varied depending upon the specifications of the particular folder.

In the left hand portion of FIG. 2, it will be seen that the tucker 12 includes an elongated member 19 equipped with a pointed end 20 for insertion between the jaws of the gripper 13' formed by the anvil 15 and the gripper element 16.

In the illustration given and with reference to FIG. 3, it will be seen that a pair of elongated members 19 are provided in end-to-end relation. Each member 19 at its radially inward side is equipped with an axially-extending stub shaft 21. Ensleeved on each shaft 21 is a bushing 22 which is received within a bearing block 23 removably fixed to cast, machined body 10'. In this fashion, the tucker elements 19 are free to pivot or "float".

To insure floatability of the tucker elements 19, the body 10' is machined with a gap 24. This advantageously is the order of about 1/16" allowing the tucker to "float" during operation, viz., when it engages a web for moving the same into the space between the gripper jaws.

The tucker gap is advantageously provided through recessing the body 10' as at 25 for a portion of its radial extent but leaving an abutment part 26.

I have found that it is important to limit the total free movement of the tucker to prevent rolls from destroying themselves during operation. With the free floating tucker of the invention, it is possible to obtain a 50% increase in the speed of the web being folded between the rolls 10 and 11 and it also allows the running of material of different thicknesses without the need for adjusting or resetting the folding rolls. Lastly, and by no means less important, is the fact that the folder runs much quieter.

In operation, the tucker 12 through its elongated member 19 which is free floating, tucks the material between the jaws of the gripper anvil 15 and the movable gripper blade 16. Advantageously, the included angle on the tucker is of the order of 60° as illustrated.

As indicated previously, the movement of the gripper blade 16 is controlled by the cam mechanism 18 and gripper receives the web material which has been partially creased by engagement with the tucker. The gripper traps the material and carries the same a given distance before releasing so as to achieve zig-zag or interfolded web material. Thus, it is advantageous for use in facial tissue, single fold tissue, multi-fold tissue and the like.

The cam mechanism 18 as seen in FIG. 1 includes a clamp block 27 fixed to the pivot shaft 17. The clamp block 27 in turn carries a cam follower roller 28. More particularly, the cam followers 28 are each rotatably mounted on stub shafts 29 carried by the plurality of clamp blocks 27. Entrained about the four (as shown) cam follower stub shafts 29 is a urethane belting 30 urging the followers 28 against the periphery of a stationary cam 31. The cam 31 is advantageously provided a part of the frame of the machine.

The cams 31 are equipped with depressed portions as at 32 permitting radially inward movement of the follower associated with the gripper being closed—as at 13' in FIG. 1.

The distance the tucker is allowed to float is dependent upon each particular layout but excellent results have been found in the normal folder with an allowable movement of approximately 1/16".

The locating abutment or shoulder 26 is advantageous in that during initial installation and setup of the rolls, the floating tucker has to be held against this shoulder by set screws 33 to properly time the rolls. After timing is complete, the tucker is released by backing out the set screws 33 and allowed to float free. The recess 25 behind the abutment 26 also provides a space for the accumulation of any debris or dirt that would build up in the folding rolls.

While in the foregoing specification a detailed description of an embodiment of the invention has been set down for the purpose of illustration, many variations in the details herein given may be made by those skilled in the art without departing from the spirit and scope of the invention.

I claim:

1. An apparatus for folding webs having a pair of rolls each equipped with tuckers and grippers and arranged for a tucker of one roll to enter into a gripper of the other roll, an improved tucker construction comprising an elongated member having a gripper-entering tip at one end and a pivot mounting at the other end, pivot means on each roll for mounting said elongated member in unbiased, free floating condition, and abutment means on each roll radially outward of said pivot means for limiting the amount of member free float to a predetermined value and for immobilizing said member for initial timing of said rolls.

2. The apparatus of claim 1 in which the amount of free float is of the order of about 1/16".

3. A method of operating a folder having a pair of rolls each equipped with tuckers and grippers and arranged for a tucker of one roll to enter into the gripper of the other roll, said tucker being an elongated member having a gripper-entering tip at one end and a pivot mounting at the other end, each roll having abutment means located radially outward of said pivot means for limiting the amount of pivotal movement of said elongated member, comprising mounting the tuckers for unbiased, slight free floating movement at the gripper entering end.

4. The method of claim 3 including temporarily clamping said elongated member to said abutment means during initial timing set up of the folding apparatus.

* * * * *